US011533969B2

(12) United States Patent
Pontaoe

(10) Patent No.: US 11,533,969 B2
(45) Date of Patent: Dec. 27, 2022

(54) SIDE RELEASE BUCKLE

(71) Applicant: Illinois Tool Works Inc., Glenview, IL (US)

(72) Inventor: John S. Pontaoe, Chicago, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 17/333,260

(22) Filed: May 28, 2021

(65) Prior Publication Data

US 2021/0392999 A1 Dec. 23, 2021

Related U.S. Application Data

(60) Provisional application No. 63/040,599, filed on Jun. 18, 2020.

(51) Int. Cl.
*A44B 11/25* (2006.01)
*A44B 11/26* (2006.01)

(52) U.S. Cl.
CPC ..... *A44B 11/2592* (2013.01)

(58) Field of Classification Search
CPC ..... A44B 11/266; A44B 11/2592; Y10T 24/45534; Y10T 24/45529; Y10T 24/45581
See application file for complete search history.

(56) References Cited

U.S. PATENT DOCUMENTS 4,631,787 A * 12/1986 Kasai ..... A44B 11/266 24/615
4,639,982 A * 2/1987 Kasai ..... A44C 5/2052 24/616
5,027,481 A * 7/1991 Frano ..... A44B 11/266 24/616
5,203,058 A * 4/1993 Krauss ..... A44B 11/266 24/616
6,226,844 B1 5/2001 Lerra
6,615,460 B1 * 9/2003 Baumgarten ..... A44B 11/266 24/615
7,089,633 B2 8/2006 Liu
7,111,368 B2 9/2006 Matoba
(Continued)

FOREIGN PATENT DOCUMENTS

EP 1400183 A2 3/2004

OTHER PUBLICATIONS

The extended European search report for Application No. 21179512.5 dated Nov. 4, 2021, European Patent Office, Germany (9 pages).

*Primary Examiner* — Robert Sandy
(74) *Attorney, Agent, or Firm* — McAndrews, Held & Malloy, Ltd.

(57) ABSTRACT

Disclosed is a buckle assembly having a female buckle component and a male buckle component. The male buckle component configured to mate with the female buckle component and comprising a main body, a mating guide beam, and one or more lateral arms coupled to the main body and configured to deflect about pivot points. Each lateral arm having a distal end configured to engage said female buckle component via a latching ledge of a button. Each lateral arm is shaped to define an effective length between the latching ledge and the pivot point that is greater than a linear distance between the latching ledge and the pivot point.

20 Claims, 4 Drawing Sheets

(56) References Cited

U.S. PATENT DOCUMENTS

| | | | |
|---|---|---|---|
| 7,140,082 | B2 | 11/2006 | Chen |
| D536,279 | S | 2/2007 | Grimm |
| 7,302,742 | B2 | 12/2007 | Pontaoe |
| 8,256,072 | B2 | 9/2012 | Kolasa |
| 8,572,820 | B2 | 11/2013 | Richards |
| 8,601,652 | B2 | 12/2013 | Uehara et al. |
| 9,655,412 | B2 | 5/2017 | Nanbu |
| 2011/0219590 | A1 | 9/2011 | Anscher |

* cited by examiner

SIDE RELEASE BUCKLE

CROSS-REFERENCE

The present application claims priority to U.S. Provisional Patent Application No. 63/040,599, filed Jun. 18, 2020, and entitled "Side Release Buckle," which is hereby incorporated by reference in its entirety.

FIELD

The present disclosure generally relates to a buckle assembly, and more particularly to a side-release buckle assembly.

BACKGROUND

A conventional side-release buckle assembly includes a male buckle component that is configured to mate with a female buckle component, such as shown and described in commonly-owned U.S. Pat. No. 7,302,742, entitled "Side-release Buckle Assembly," and U.S. Pat. No. 8,256,072, entitled "Buckle." Each of the male buckle component and the female buckle component of the buckle is configured to retain a lead. The male buckle component includes integral buttons that may be engaged to release the male buckle component from the female buckle component, thereby disconnecting the buckle assembly.

The compression forces to release and assemble the buckle assembly are a function of the buckle's arm length. For example, a longer arm is more easily biased than a shorter arm. It is sometimes desirable to use arms that are more easily biased or flexed, they making it easier to release and assemble the buckle assembly. Increasing the buckle's arm length, however, traditionally increases the overall width of the buckle assembly, yet products often impose constraints on the overall width of the buckle assembly. It would therefore be highly desirable to provide a buckle assembly that is easier to release and assemble, while minimizing the overall width of the buckle assembly.

SUMMARY

The present disclosure relates generally to a buckle assembly, and more particularly to a side-release buckle assembly, substantially as illustrated by and described in connection with at least one of the figures, as set forth more completely in the claims.

DRAWINGS

The foregoing and other objects, features, and advantages of the devices, systems, and methods described herein will be apparent from the following description of particular examples thereof, as illustrated in the accompanying figures; where like or similar reference numbers refer to like or similar structures. The figures are not necessarily to scale, emphasis instead being placed upon illustrating the principles of the devices, systems, and methods described herein.

Figure 1A:
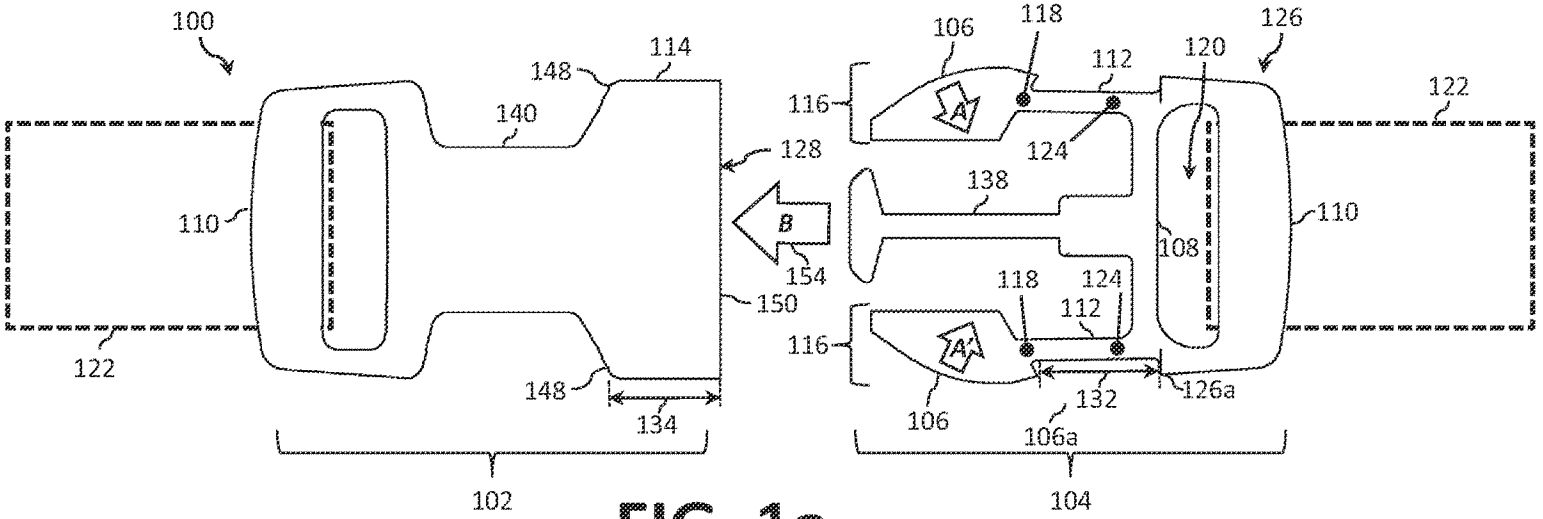
Figure 1B:
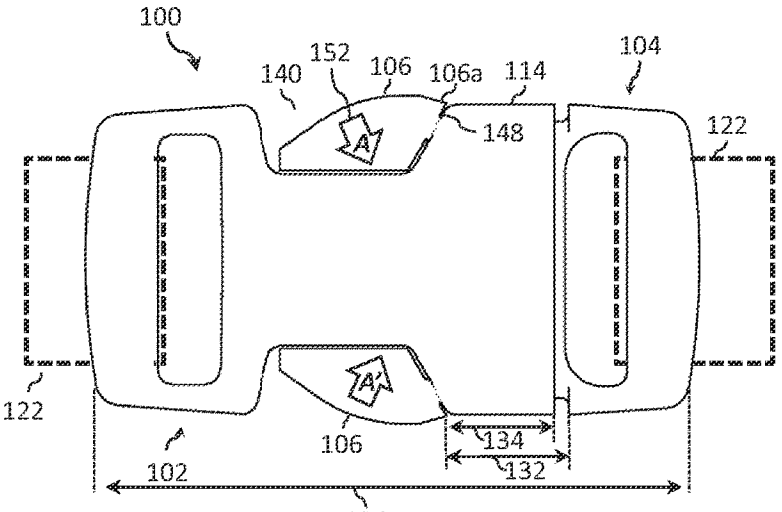

FIGS. 1*a* and 1*b* illustrate, respectively, top plan views of disconnected and connected buckle assemblies in accordance with aspects of this disclosure.

Figure 1C:
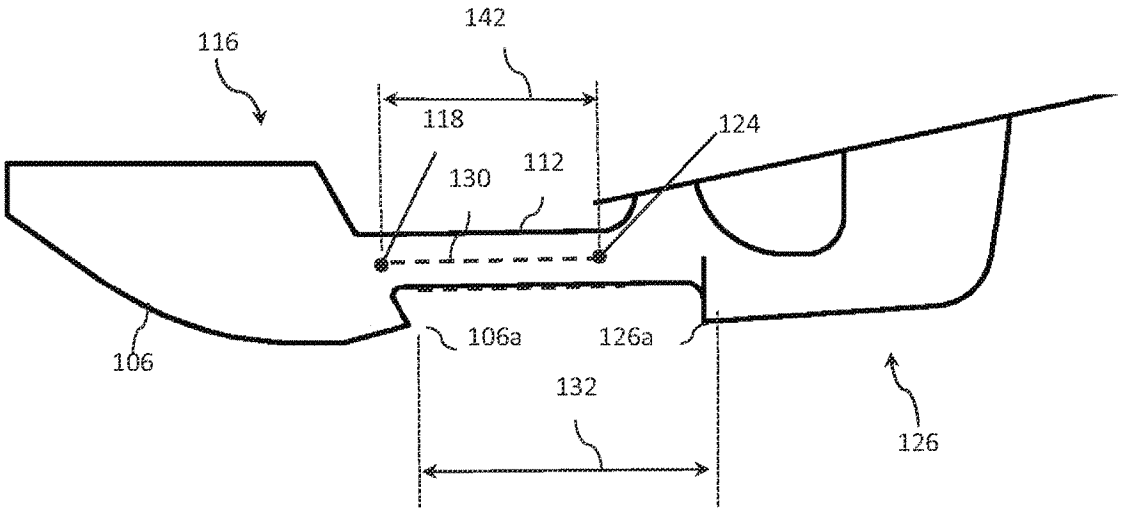

FIG. 1*c* illustrates an enlarged view of the linear arm member of the buckle assembly of FIGS. 1*a* and 1*b*.

Figure 1D:
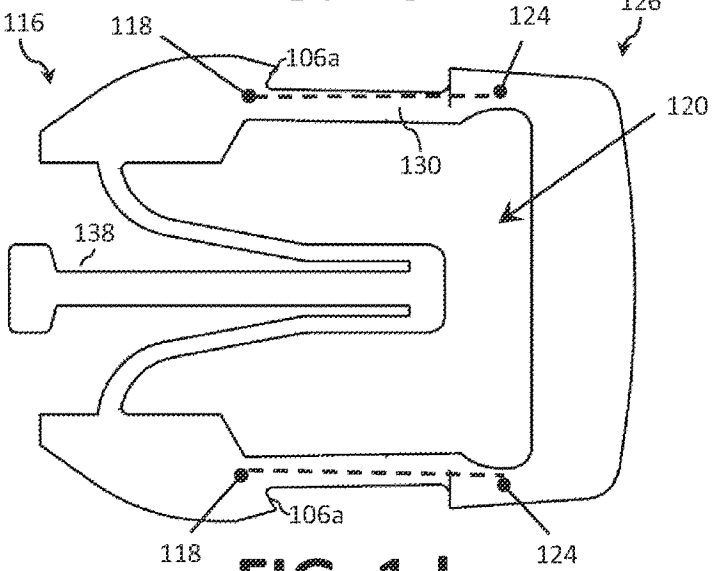

FIG. 1*d* illustrates the male buckle component of FIGS. 1*a* through 1*c* without a rigid strut member.

Figure 2A:
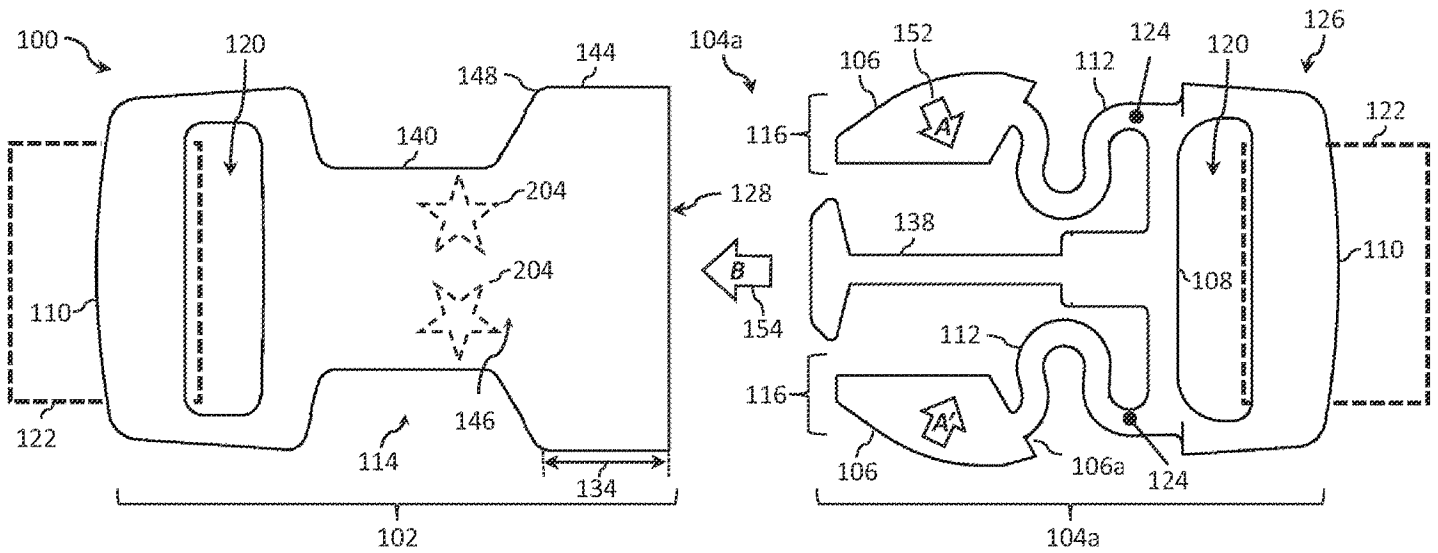

FIG. 2*a* illustrates a disconnected buckle assembly with a male buckle component in accordance with a first aspect of this disclosure.

Figure 2B:
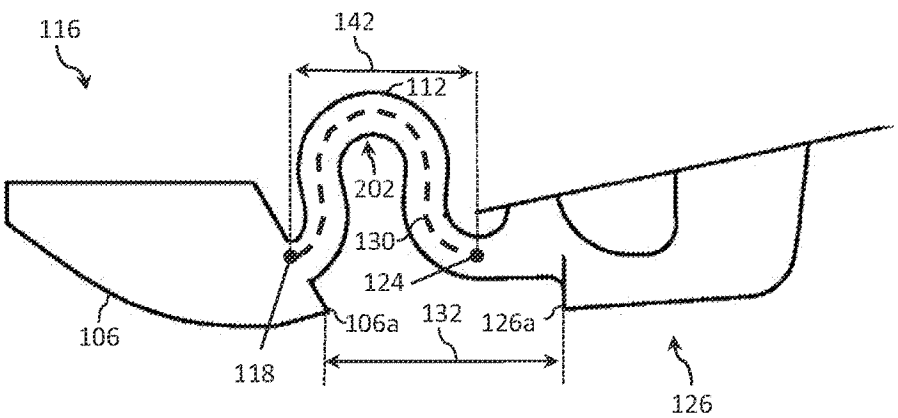

FIG. 2*b* illustrates an enlarged view of the non-linear arm member of the male buckle component of FIG. 2*a*.

Figure 2C:
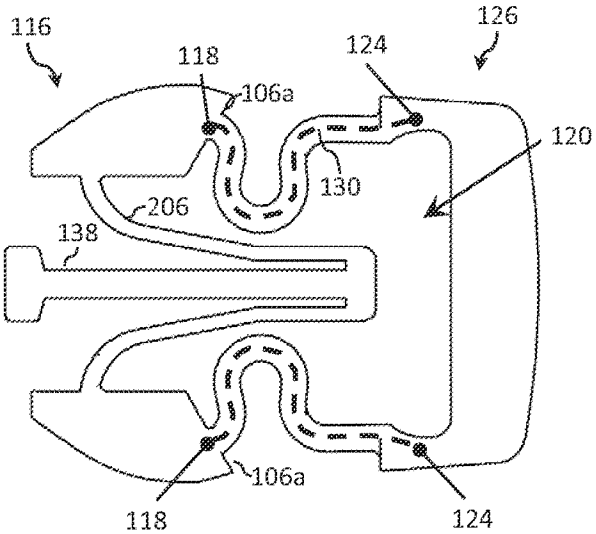

FIG. 2*c* illustrates the male buckle component of FIGS. 2*a* and 2*b* without a rigid strut member.

Figure 3A:
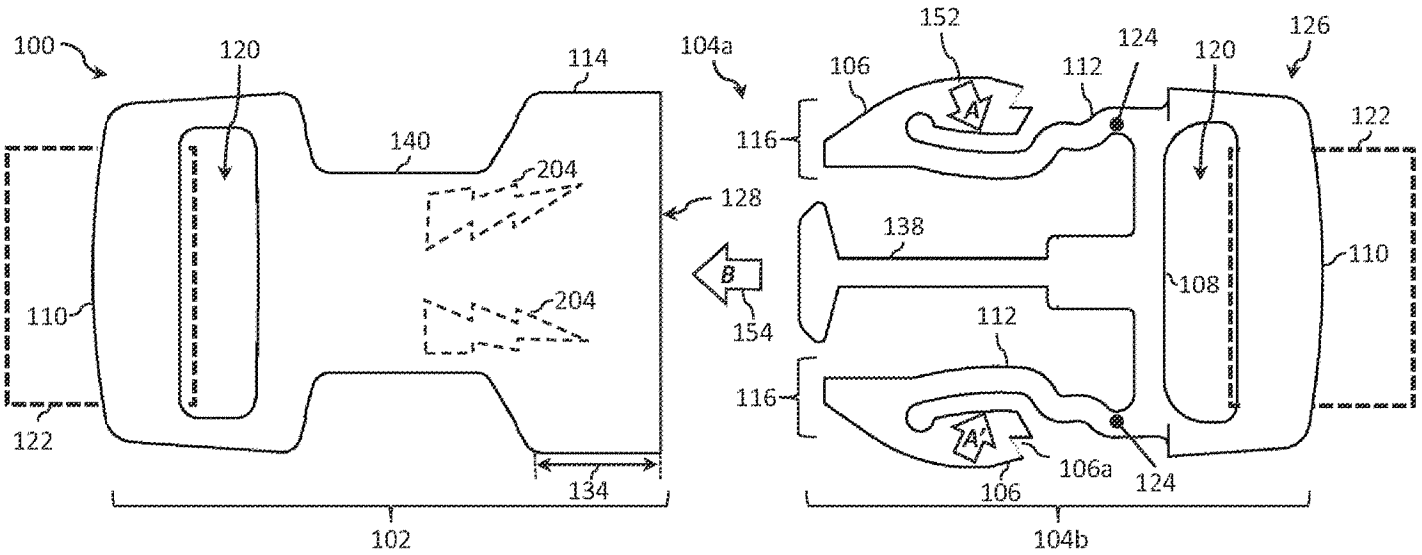

FIG. 3*a* illustrates a disconnected buckle assembly with a male buckle component in accordance with a second aspect of this disclosure.

Figure 3C:
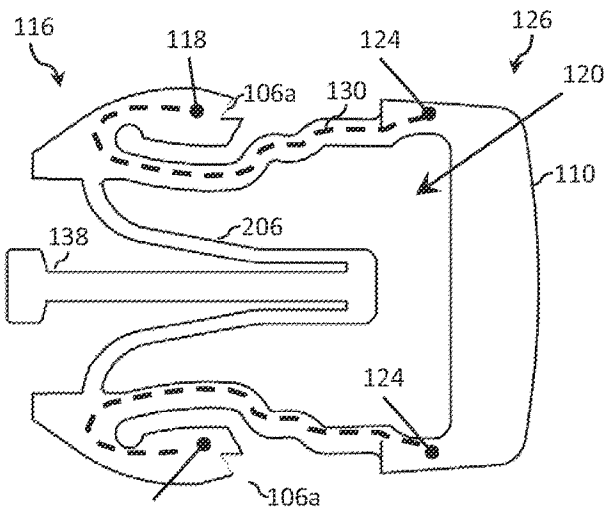
Figure 3B:
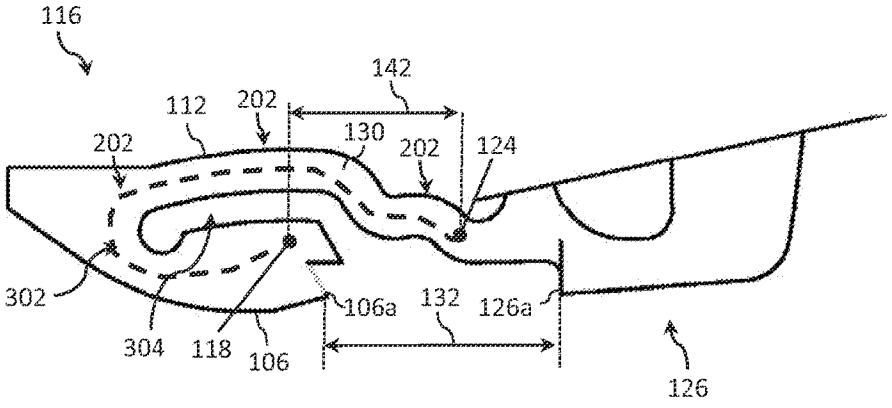

FIG. 3*b* illustrates an enlarged view of the non-linear arm member of the male buckle component of FIG. 3*a*.

FIG. 3*c* illustrates the male buckle component of FIGS. 3*a* and 3*b* without a rigid strut member.

DESCRIPTION

References to items in the singular should be understood to include items in the plural, and vice versa, unless explicitly stated otherwise or clear from the text. Grammatical conjunctions are intended to express any and all disjunctive and conjunctive combinations of conjoined clauses, sentences, words, and the like, unless otherwise stated or clear from the context. Recitation of ranges of values herein are not intended to be limiting, referring instead individually to any and all values falling within and/or including the range, unless otherwise indicated herein, and each separate value within such a range is incorporated into the specification as if it were individually recited herein. In the following description, it is understood that terms such as "first," "second," "top," "bottom," "side," "front," "back," and the like are words of convenience and are not to be construed as limiting terms. For example, while in some examples a first side is located adjacent or near a second side, the terms "first side" and "second side" do not imply any specific order in which the sides are ordered.

The terms "about," "approximately," "substantially," or the like, when accompanying a numerical value, are to be construed as indicating a deviation as would be appreciated by one of ordinary skill in the art to operate satisfactorily for an intended purpose. Ranges of values and/or numeric values are provided herein as examples only, and do not constitute a limitation on the scope of the disclosure. The use of any and all examples, or exemplary language ("e.g.," "such as," or the like) provided herein, is intended merely to better illuminate the disclosed examples and does not pose a limitation on the scope of the disclosure. The terms "e.g.," and "for example" set off lists of one or more non-limiting examples, instances, or illustrations. No language in the specification should be construed as indicating any unclaimed element as essential to the practice of the disclosed examples.

The term "and/or" means any one or more of the items in the list joined by "and/or." As an example, "x and/or y" means any element of the three-element set {(x), (y), (x, y)}. In other words, "x and/or y" means "one or both of x and y". As another example, "x, y, and/or z" means any element of the seven-element set {(x), (y), (z), (x, y), (x, z), (y, z), (x, y, z)}. In other words, "x, y, and/or z" means "one or more of x, y, and z."

A buckle assembly can be used to join two or more components, such as a lead (e.g., straps, ropes, strips, cordage, or another material to be fastened). In one example, a male buckle component is configured to mate with a female buckle component into a securely connected position, where the male buckle component comprises: a main body; a mating guide beam; and one or more lateral arms coupled to the main body and configured to deflect about pivot points, each of said one or more lateral arms having a distal end configured to engage said female buckle component via a latching ledge of a button, wherein each of said one or more lateral arms is shaped to define an effective length between the latching ledge and the pivot point that is greater than a linear distance between the latching ledge and the pivot point.

In some examples, the main body may comprise a rigid strut member, where the one or more lateral arms are coupled to the main body at the rigid strut member. The mating guide beam may extends outwardly from said rigid strut member. Each of said one or more lateral arms defines a non-linear portion. The non-linear portion may be configured to cause at least a portion of the lateral arm to extend beyond the distal end from the main body. For example at least a portion of the lateral arm overlaps upon itself. In some examples, each of said one or more lateral arms defines two non-linear portions. The male buckle component may further comprises a lead bar configured to secure a lead to the main body. The button may be configured to engage at least one button window formed in the female buckle component via a latching ledge when one or more lateral arms are inserted into the female buckle component. In some examples, the one or more lateral arms includes two lateral arms where the main body spring-biasing said two lateral arms apart from one another.

In another example, a male buckle component configured to mate with a female buckle component into a securely connected position, where the male buckle component comprises: a main body; a mating guide beam; and one or more lateral arms coupled to the main body and configured to deflect about pivot points, each of said one or more lateral arms having a distal end configured to engage said female buckle component via a latching ledge of a button, wherein each of said one or more lateral arms is shaped to define an effective length between the latching ledge and the pivot point that is greater than a linear distance between the latching ledge and the pivot point, and wherein each of said one or more lateral arms defines a non-linear portion that is configured to cause at least a portion of the lateral arm to extend beyond the distal end. Each of said male buckle component and female buckle component may comprise a lead-receiving channel. The button may be configured to be engaged to disconnect said male buckle component from said female buckle component.

In yet another example, a buckle assembly comprises: a female buckle component having a housing that defines a pocket and a button window; and a male buckle component having a main body, a mating guide beam, and one or more lateral arms coupled to the main body, wherein the button window is configured to engage a latching ledge of a button positioned at a distal end of at least one of the one or more lateral arms when inserted into the pocket, and wherein each of the one or more lateral arms is configured to deflect about a pivot point and is shaped to define an effective length between the latching ledge and the pivot point that is greater than a linear distance between the latching ledge and the pivot point. Each of the female buckle component and the male buckle component comprises a lead-receiving channel. The latching ledge may be configured to engage a lock ledge defined by the housing. The pivot point may be proximate a rigid strut member of the main body. The button may be configured to be engaged to disconnect said male buckle component from said female buckle component. The one or more lateral arms includes two lateral arms, said main body spring-biasing said two lateral arms apart from one another. Each of said one or more lateral arms defines a non-linear portion that may be configured to cause at least a portion of the lateral arm to extend beyond the distal end.

FIG. 1*a* illustrates a top plan view of a disconnected buckle assembly 100, while FIG. 1*b* illustrates a top plan view of a connected buckle assembly 100. FIG. 1*c* illustrates an enlarged view of the arm member 116 of the buckle assembly 100. As illustrated, the buckle assembly 100 is configured as a side-release buckle assembly that includes a male buckle component 104 and a female buckle component 102. In operation, the pair of lateral arm members 116 is inserted into and received by a pocket 128 of female buckle component 102 to latch the buckle assembly 100. The pair of lateral arm members 116 is inserted via an insertion force 154, which is indicated by Arrow B. The buckle assembly 100 is released or disconnected by providing compression forces 152 inwardly from the side as indicated by Arrows A and A'. The male buckle component 104 and the female buckle component 102 can be made as individual monolithic structures of plastic formed by injection molding processes, or the like.

Leads 122 can be attached to each of the male buckle component 104 and the female buckle component 102 so that buckle assembly 100 can be used to secure together opposite ends of a single lead 122 or to secure ends of separate leads 122. Example leads 122 include, inter alia, straps (e.g., backpack straps, belts, etc.), ropes, strips, cordage, or another material to be fastened. The leads 122 may be fabricated from, for example, plastic, nylon, leather, fabric, etc. In some examples, each of the male buckle component 104 and the female buckle component 102 may be adjustably positioned along the length of a lead 122. Other structures or components, however, may be used to couple to the male buckle component 104 and/or the female buckle component 102 in addition to, or in lieu of, the leads 122. For example, the male buckle component 104 and/or the female buckle component 102 may be coupled to an item (e.g., bag, belt, garment, etc.) via mechanical fasteners (e.g., snaps, rivets, carabiner clips, etc.), adhesives, etc.

In order to securely mate the male buckle component 104 into the female buckle component 102, the male buckle component 104 is urged into the female buckle component 102 via insertion force 154. The female buckle component 102 defines a receiving body or pocket 128. In some examples, the female buckle component 102 includes a housing 114 formed as a set of plates 146 spaced apart and secured at the edges via the sides 144 to form a pocket-like structure to define the pocket 128. The sides 144 of the housing 114 are shaped to define button windows 140 (e.g., openings in the sides 144). The button windows 140 are sized and positioned to receive buttons 106 when the male buckle component 104 is fully inserted into the pocket 128 of the female buckle component 102. The pocket 128 may further define one or more channels to define a guide way to direct male buckle component 104 straight into female buckle component 102 from an entrance opening 150 to the pocket 128. The one or more channels may be form on, for example, in interior surface of the set of plates 146. The one or more channels may be configured to guide the male buckle component 104 via a mating guide beam 138 that outwardly extends from a rigid strut member. For example, using insertion force 154 as indicated by Arrow B, the mating guide beam 138 passes into a mating channel or sleeve formed in the female buckle component in order to assure proper mating alignment. Once the buttons 106 are snapably secured into the button windows 140 formed in the female buckle component 102, the male buckle component 104 is securely retained within the female buckle component 102.

The housing 114 further includes one or more lock ledges 148 to interface with the male buckle component 104. For example, an edge of each button windows 140 nearest the entrance opening to the pocket 128 may define the lock ledge 148 or be provided another form of pediment.

The male buckle component 104 includes a pair of lateral arm members 116. While the pair of lateral arm members 116 are illustrated as generally parallel one another, they may be non-parallel. Each of the lateral arm members 116 includes a flexible lateral arm 112 with a button 106 at a distal end 118 thereof. As illustrated, the flexible lateral arms 112 are spaced apart and generally parallel to one another. In some examples, the flexible lateral arm 112 and the buttons 106 are fabricated as a unitary structure. In some examples, the flexible lateral arm 112 and the buttons 106 are distinct components. For example, the buttons 106 may be a solid, rigid button coupled to an end of the flexible lateral arm 112. In other examples, the flexible lateral arm 112 may be configured to form a non-linear portion that defines, or otherwise serves as, the button 106. For example, the flexible lateral arm 112 may be shaped to define the button 106. In either arrangement, the buttons 106 define a latching ledge 106*a* configured to engage the female buckle component 102. For example, the latching ledge 106*a* may engage a lock ledge 148 defined by the housing 114 of the female buckle component 102.

When the buckle assembly 100 is latched, as best illustrated in FIG. 1*b*, the portion of the female buckle component 102 between the lock ledge 148 and the entrance opening 150 resides within the area of the male buckle component 104 between the latching ledge 106*a* and the shoulder 126*a*. To that end, the distance 132 between the latching ledge 106*a* and the shoulder 126*a* of the main body 126 is dictated by the distance 134 between the lock ledge 148 and the entrance opening 150 of the female buckle component 102. In some examples, the distance 132 and the distance 134 are about the same (e.g., within a 5% deviation) or the distance 132 is slightly larger than the distance 134 (e.g., about 10% larger, as represented in FIG. 1*b*).

In some examples, a rigid strut member 108 extends between the lateral arm members 116. The rigid strut member 108 is generally perpendicular to the lateral arm members 116. A lead-receiving channel 120 is formed through the male buckle component 104 between, for example, the rigid strut member 108 and a lead bar 110. In some examples, the rigid strut member 108 and the lead bar 110 are parallel to one another. The lead-receiving channel 120 is configured to secure the lead 122. The lateral arm members 116 are integrally connected to the main body 126 at pivot points 124 (e.g., via the rigid strut member 108). The lateral arm members 116 are configured to pivot (e.g., flex) in the direction of arcs A and A' about pivot points 124 defined by the union of the rigid strut member 108 and the lateral arm members 116. In other words, the lateral arm members 116 are rigidly coupled at pivot points 124 and configured to flex inwardly along its length (e.g., its effective length 130) in the direction of arcs A and A'.

In general, the rigid strut member 108 is disposed between the pivot points 124 and adjacent the lead-receiving channel 120. In one example, the pivot points 124 are proximate the rigid strut member 108 of the main body 126. As such, the pivot points 124 are distally located from the lead bar 110 and the rigid strut member 108. As shown in FIG. 1*a*, the rigid strut member 108 extends between the arm members 116 and is integrally connected with the lead bar 110 to form a main body 126 of the male buckle component 104. Thus, the rigid strut member 108 is inflexible. While the main body 126 is illustrated with a rigid strut member 108, the rigid strut member 108 may be omitted and the lateral arm members 116 can be integrally connected to the main body 126 at another location. For example, the lateral arm members 116 can be connected at the lead bar 110.

In operation, the pair of lateral arm members 116 is inserted into and received by pocket 128 of female buckle component 102 as indicated by Arrow B to latch the buckle assembly 100. In order to secure the male buckle component 104 into the female buckle component 102, the male buckle component 104 is urged into the female buckle component 102 in the direction of arrow B. The mating guide beam 138 of the male buckle component 104 moves into a reciprocal channel formed in the pocket 128 of the female buckle component 102 to ensure proper mating alignment between the female and male buckle components 102 and 104, respectively.

As the male buckle component 104 is urged into the female buckle component 102, the lateral arm members 116 deflect inwardly (e.g., deformed or flexed) in the directions of arcs A and A' until the buttons 106 reach button openings 140 formed through the female buckle component 102. To that end, the flexible lateral arm 112 is configured to flex along its effective length 130 between the pivot point 124 and a latching ledge at its distal end 118. For purposes of this disclosure, the effective length 130 refers to the length along the flexible lateral arm 112 to enable the flexible lateral arm 112 to flex between the pivot point 124 and the distal end latching ledge 106*a* during coupling and decoupling of the buckle assembly 100. The effective length 130 is a function of the shape of the flexible lateral arm 112. In the example of FIGS. 1*a* through 1*c*, the flexible lateral arm 112 are generally linear (e.g., straight) with a solid, rigid button 106 coupled at the distal end 118 that defines the latching ledge 106*a*. As can be appreciated, in this case, the effective length 130 of the flexible lateral arm 112 is substantially equal to the linear distance 142 (e.g., a straight line distance) between the pivot point 124 and the latching ledge 106*a*.

When the buttons 106 enter the button openings 140 in response to the insertion force 154, the tension stored in the lateral arm members 116 (via the flexible lateral arm 112) biases the buttons 106 laterally outward (e.g., in directions opposite that of arrows A and A') such that the buttons 106 are secured within the button openings 140. At this point, the male buckle component 104 is secured to the female buckle component 102. FIG. 1*b* illustrates a top plan view of the buckle assembly 100 in which the male buckle component 104 is securely mated into the female buckle component 102. In order to disconnect the male buckle component 104 from the female buckle component 102, the buttons 106 are squeezed inwardly (e.g., from the sides) toward one another in the direction of arcs A and A'.

Increasing the effective length 130 of the flexible lateral arm 112 decreases the amount of compression force 152 needed in directions A and A' to bias the lateral arm members 116, thereby making it easier to couple and decouple the buckle assembly 100. For example, lower compression forces 152 results in a lower insertion force 154. That is, a flexible lateral arm 112 having a longer effective length 130 is more easily biased than shorter equivalents thereof and, therefore, requires a lower compression force 152.

It is sometimes desirable to use lateral arms 112 that are more easily biased, thus making it easier to release and assemble the buckle assembly 100. When a linear flexible lateral arm 112 is used, however, increasing the effective length 130 increases the linear distance 142 between the pivot point 124 and the latching ledge 106*a*, which results in a larger arm members 116 and, therefore, larger male buckle component 104.

Increasing the buckle's arm length traditionally increases the overall width 136 of the buckle assembly 100. In order to accommodate the larger male buckle component 104, the female buckle component 102 must likewise be larger (e.g., the distance 134 between the lock ledge 148 and the entrance opening 150 must be increased to accommodate the longer flexible lateral arm 112), resulting in a buckle assembly 100 having a larger overall width 136. The overall width 136 of the buckle assembly 100 is dictated by the particular application and, for that reason, is not always a viable solution. That is, products often impose constraints on the overall width 136 of the buckle assembly 100. For example, whether for visual appearance or space limitations, the buckle assembly 100 may be limited to a given overall width 136, while requiring a lower compression force 152.

To increase the effective length 130 of the flexible lateral arm 112 without increasing the linear distance 142, a non-linear flexible lateral arm 112 may be employed. As will be described in the following examples, the non-linear flexible lateral arm 112 includes one or more the non-linear portions 202 that increase the effective length 130 between the pivot point 124 and the latching ledge 106*a*, without affecting the linear distance 142 between the pivot point 124 and the latching ledge 106*a*. In some examples, the rigid strut member 108 may be omitted and the lateral arm members 116 can be integrally connected to the main body 126 at another location. For example, the lateral arm members 116 can be connected to the main body 126 at pivot point 124 as illustrated in FIG. 1*d*. In this example, removing the rigid strut member 108 increases the effective length 130 compared to that of FIGS. 1*a* through 1*c*.

FIG. 2*a* illustrates a disconnected buckle assembly 100 with a male buckle component 104*a* according to a first example, while FIG. 2*b* illustrates an enlarged view of the arm member 116 of the male buckle component 104*a*. The buckle assembly 100 of FIGS. 2*a* and 2*b* is substantially the same as the buckle assembly 100 described in connection with FIGS. 1*a* and 1*b*, except for the male buckle component's 104*a* arm member 116, which is configured with an increased effective length 130, while preserving the same linear distance 142. That is, the effective length 130 is greater than the linear distance 142. In this example, the buttons 106 are provided as a solid, rigid button 106 coupled to the flexible lateral arms 112 at the distal ends 118 thereof. The buttons 106 are integrally connected to the flexible lateral arms 112.

As illustrated, the flexible lateral arm 112 of the arm member 116 is non-linear and shaped to define one or more non-linear portions 202, which serve to increase the effective length 130. By introducing one or more non-linear portions 202, the effective length 130 is increased without affecting the linear distance 142. In some examples, the non-linear portions 202 are arc-shaped (e.g., circular or partially circular). In the illustrated example, the non-linear portion 202 is arc-shaped and oriented inwardly toward the mating guide beam 138.

While the flexible lateral arm 112 is illustrated with one non-linear portion 202, additional non-linear portions 202 may be used depending on a desired effective length 130. Further, the size and shape of each non-linear portion 202 may be adjusted to achieve a desired effective length 130. For example, to increase the effective length 130, additional or larger non-linear portions 202 may be provided. Conversely, the size of the non-linear portions 202 may be reduced to reduce the effective length 130.

In some examples, the size and shape of the non-linear portions 202 may be adjusted to accommodate aspects of the female buckle component 102. For example, some buckle assemblies 100 may employ a female buckle component 102 with designs or features positioned on the housing 114 (e.g., in or on the plates 146). By way of illustration, a user may require that the housing 114 be shaped (e.g., cut, die cut, molded, etc.) to define one or more cutouts 204, which may be a logo, shape, or other design. In such cases, the flexible lateral arm 112 and non-linear portions 202 may be shaped such that they do not obstruct the cutouts 204 when viewed from above. For illustrative purposes, cutouts 204 are illustrated as stars in FIG. 2*a*. In this example, the flexible lateral arm 112 is shaped such that it would not block the star-shaped cutouts 204 when assembled. As noted above, in some examples, the rigid strut member 108 may be omitted and the lateral arm members 116 can be integrally connected to the main body 126 at another location. For example, the lateral arm members 116 can be connected to the main body 126 at pivot point 124 as illustrated in FIG. 2*c*. In this example, removing the rigid strut member 108 increases the effective length 130 compared to that of FIGS. 2*a* and 2*b*. The guide beam 138 can be secured to the button 106 (or another component of the buckle) via, for example, a flexible, resilient webbing 206.

FIG. 3*a* illustrates a disconnected buckle assembly 100 with a male buckle component 104*b* according to a second example, while FIG. 3*b* illustrates an enlarged view of the arm member 116 of the male buckle component 104*b*. The buckle assembly 100 of FIGS. 3*a* and 3*b* is substantially the same as the buckle assembly 100 described in connection with FIGS. 1*a* and 1*b*, except for the male buckle component's 104*b* arm member 116, which is configured with an increased effective length 130, while preserving the same linear distance 142. Like the male buckle component 104*a* of FIGS. 2*a* and 2*b*, the flexible lateral arm 112 of the arm member 116 is non-linear and shaped to define one or more non-linear portions 202 to increase the effective length 130. In this example, the flexible lateral arm 112 of the male buckle component 104*b* is shaped such that at least a portion of the lateral arm 112 extends beyond the distal end 118 thereof. Rather than employing a solid, rigid button 106 coupled at the distal end 118, the flexible lateral arm 112 itself defines the button 106 via one or more non-linear portions 202. As a result, the effective length 130 is further extended without affecting the linear distance 142. Further, the design of FIGS. 3*a* and 3*b* allowed for a larger amount of hollow space (aka, negative space) between the mating guide beam 138 and each of the arm members 116 because the non-linear portions 202 need not extend inwardly as much to achieve an equivalent effective length 130. In the illustrated example, the non-linear portion 202 is configured to cause at least a portion 302 of the lateral arm 112 to overlap upon itself at an overlapping region 304. The overlapping region 304 can also serve as a button 106, yet is flexible. As noted above, the flexible lateral arm 112 and non-linear portions 202 may be shaped such that they do not obstruct the cutouts 204. For illustrative purposes, cutouts 204 are illustrated as lightning bolts in FIG. 3*a*. In this example, the flexible lateral arm 112 is shaped such that it would not block the lightning bolt-shaped cutouts 204 when assembled. As noted above, in some examples, the rigid strut member 108 may be omitted and the lateral arm members 116 can be integrally connected to the main body 126 at another location. For example, the lateral arm members 116 can be connected to the main body 126 at pivot point 124 as illustrated in FIG. 3*c*. In this example, removing the rigid strut member 108 increases the effective length 130 compared to that of FIGS. 3*a* and 3*b*. The guide beam 138 can be secured to the button 106 (or another component of the buckle) via, for example, a flexible, resilient webbing 206.

Thus, examples of the present disclosure provide a buckle assembly having mating components that may be easily disconnected. In particular, examples of the present disclosure provide a side-release buckle assembly in which a male buckle component may be disconnected from a female buckle component using less force as compared to conventional side-release buckle assemblies.

While the present method and/or system has been described with reference to certain implementations, it will be understood by those skilled in the art that various changes may be made and equivalents may be substituted without departing from the scope of the present method and/or system. In addition, many modifications may be made to adapt a particular situation or material to the teachings of the present disclosure without departing from its scope. For example, block and/or components of disclosed examples may be combined, divided, re-arranged, and/or otherwise modified. Therefore, the present method and/or system are not limited to the particular implementations disclosed. Instead, the present method and/or system will include all implementations falling within the scope of the appended claims, both literally and under the doctrine of equivalents.

The invention claimed is:

1. A male buckle component configured to mate with a female buckle component into a securely connected position, said male buckle component comprising:

a main body;

a mating guide beam; and two or more lateral arms coupled to the main body and configured to deflect about pivot points, each of said two or more lateral arms having a distal end configured to engage said female buckle component via a latching ledge of a button, wherein each of said two or more lateral arms is shaped to define an effective length between the latching ledge and the pivot point that is greater than a linear distance between the latching ledge and the pivot point, and wherein said two or more lateral arms are spring-based apart from one another via the main body.

2. The male buckle component of claim 1, wherein the main body comprises a rigid strut member, said two or more lateral arms being coupled to the main body at the rigid strut member.

3. The male buckle component of claim 2, wherein the mating guide beam extends outwardly from said rigid strut member.

4. The male buckle component of claim 1, wherein each of said two or more lateral arms defines a non-linear portion.

5. The male buckle component of claim 4, wherein the non-linear portion is configured to cause at least a portion of the lateral arm to extend beyond the distal end from the main body.

6. The male buckle component of claim 4, wherein at least a portion of the lateral arm overlaps upon itself.

7. The male buckle component of claim 1, wherein each of said two or more lateral arms defines two non-linear portions.

8. The male buckle component of claim 1, wherein said male buckle component further comprises a lead bar configured to secure a lead to the main body.

9. The male buckle component of claim 1, wherein the button is configured to engage at least one button window formed in the female buckle component via a latching ledge when said two or more lateral arms are inserted into the female buckle component.

10. A male buckle component configured to mate with a female buckle component into a securely connected position, said male buckle component comprising:

a main body;

a mating guide beam; and one or more lateral arms coupled to the main body and configured to deflect about pivot points positioned proximate a rigid strut member of the main body, each of said one or more lateral arms having a distal end configured to engage said female buckle component via a latching ledge of a button, wherein each of said one or more lateral arms is shaped to define an effective length between the latching ledge and the pivot point that is greater than a linear distance between the latching ledge and the pivot point, and wherein each of said one or more lateral arms defines a non-linear portion that is configured to cause at least a portion of the lateral arm to extend beyond the distal end.

11. The male buckle component of claim 10, wherein each of said male buckle component and female buckle component comprises a lead-receiving channel.

12. The male buckle component of claim 10, wherein said button is configured to be engaged to disconnect said male buckle component from said female buckle component.

13. A buckle assembly comprising:

a female buckle component having a housing that defines a pocket and at least one button window; and a male buckle component having a main body, a mating guide beam, and two or more lateral arms coupled to the main body, wherein each button window is configured to engage a latching ledge of a button positioned at a distal end of at least one of the two or more lateral arms when inserted into the pocket, wherein each of the two or more lateral arms is configured to deflect about a pivot point and is shaped to define an effective length between the latching ledge and the pivot point that is greater than a linear distance between the latching ledge and the pivot point, and wherein said two or more lateral arms are spring-biased apart from one another via the main body.

14. The buckle assembly of claim 13, wherein each of the female buckle component and the male buckle component comprises a lead-receiving channel.

15. The buckle assembly of claim 13, wherein the latching ledge is configured to engage a lock ledge defined by the housing.

16. The buckle assembly of claim 13, wherein said pivot point is proximate a rigid strut member of the main body.

17. The buckle assembly of claim 13, wherein the button is configured to be engaged to disconnect said male buckle component from said female buckle component.

18. The buckle assembly of claim 13, wherein each of said two or more lateral arms defines a non-linear portion that is configured to cause at least a portion of the lateral arm to extend beyond the distal end.

19. The buckle assembly of claim 13, wherein the female buckle component defines one or more cutouts.

20. The buckle assembly of claim 19, wherein the two or more lateral arms are shaped such that they do not obstruct the cutouts when the male buckle component is inserted into the female buckle component.

* * * * *